US011600970B1

(12) United States Patent
Langley et al.

(10) Patent No.: US 11,600,970 B1
(45) Date of Patent: Mar. 7, 2023

(54) SPARK-PLUG WIRE HAVING HEAT SHIELD WITH RETENTION FEATURES

(71) Applicant: FORD GLOBAL TECHNOLOGIES, LLC, Dearborn, MI (US)

(72) Inventors: Christopher Scott Langley, Canton, MI (US); Paul S. Bonell, Dearborn, MI (US); Nelson William Morrow, Jr., Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/495,044

(22) Filed: Oct. 6, 2021

(51) Int. Cl.

| | |
|---|---|
| ***H01T 13/05*** | (2006.01) |
| ***H01T 13/16*** | (2006.01) |
| ***H01T 13/04*** | (2006.01) |
| *H01T 13/22* | (2006.01) |

(52) U.S. Cl.
CPC ..... *H01T 13/05* (2013.01); *H01T 13/04* (2013.01); *H01T 13/16* (2013.01); *H01T 13/22* (2013.01)

(58) Field of Classification Search
CPC ..... H01T 13/16; H01T 13/04; H01T 13/05
USPC ..... 439/485
See application file for complete search history.

(56) References Cited

U.S. PATENT DOCUMENTS

| | | | | |
|---|---|---|---|---|
| 4,671,586 | A * | 6/1987 | DeBolt | H01T 13/04 439/126 |
| 6,193,528 | B1 | 2/2001 | Rea et al. | |
| 6,467,447 | B1 | 10/2002 | Holmes et al. | |
| 10,938,185 | B1 | 3/2021 | Matulich | |
| 2002/0166528 | A1* | 11/2002 | Holmes | H01T 13/04 123/169 PA |
| 2006/0223354 | A1 | 10/2006 | Hafele et al. | |
| 2019/0157846 | A1* | 5/2019 | Schumm | H01F 38/12 |

* cited by examiner

*Primary Examiner* — Christopher M Raabe
(74) *Attorney, Agent, or Firm* — Vincent Mastrogiacomo; Brooks Kushman P.C.

(57) ABSTRACT

A spark-plug wire includes a boot of electrically insulative material defining a central bore configured to receive a spark plug, an electrical connector disposed in the central bore and configured to connect with the spark plug, and a cylindrical heat shield circumscribing the boot. The heat shield has retaining features extending past a distal end of the boot and configured to radially flex to engage with a hex of the spark plug to increase a retaining force of the spark-plug wire to the spark plug.

20 Claims, 3 Drawing Sheets

SPARK-PLUG WIRE HAVING HEAT SHIELD WITH RETENTION FEATURES

TECHNICAL FIELD

This disclosure relates to internal-combustion engines and more particularly to spark-plug wires.

BACKGROUND

An internal-combustion engine may include spark ignition. The spark ignition is provided by spark plugs that are positioned in combustion chambers of the engine. The spark plug includes first and second electrodes that are spaced apart from each other to produce an electric arc (spark) when current is supplied to the spark plug by an ignition system. Current is supplied to the spark plugs at select timing to ignite the air-fuel mixture within the combustion chamber according to engine timing. Spark-plug wires connect the spark plugs to the ignition system. The wire includes a boot configured to couple with the spark plug and a cable portion that extends from the boot to connect with a component of the ignition system, such as a coil pack or distributor.

SUMMARY

According to one embodiment, a spark-plug wire includes a boot of electrically insulative material defining a central bore configured to receive a spark plug, an electrical connector disposed in the central bore and configured to connect with the spark plug, and a cylindrical heat shield circumscribing the boot. The heat shield has retaining features extending past a distal end of the boot and configured to radially flex to engage with a hex of the spark plug to increase a retaining force of the spark-plug wire to the spark plug.

According to another embodiment, a spark-plug wire includes a boot, an electrical terminal disposed in the boot and configured to couple with an electrode of a spark plug, and a cylindrical heat shield disposed around the boot. The heat shield has a plurality of longitudinally extending, slots defining gripping claws integral with the heat shield. The gripping claws are extendable over a hex of the spark plug to allow engagement with a backside of the hex. The gripping claws are radially deflectable allowing the heat shield to be received, past the hex and are biased radially inward to grip the backside and increase a retaining force of the spark-plug wire to the spark plug.

According to yet another embodiment, a spark-plug assembly includes a spark plug and a spark-plug wire. The spark-plug wire includes a boot, an electrical connector disposed in the boot and coupled to a terminal of the spark plug, and a cylindrical heat shield. The heat shield is disposed around the boot and has a plurality of longitudinally extending slots defining gripping claws integral with the heat shield. The gripping claws extend over a hex of the spark plug to engage with a backside of the hex. The gripping claws are radially deflectable allowing the heat shield to be received past the hex and are biased radially inward to grip the backside and increase a retaining force of the spark-plug wire to the spark plug.

DETAILED DESCRIPTION

Figure 1:
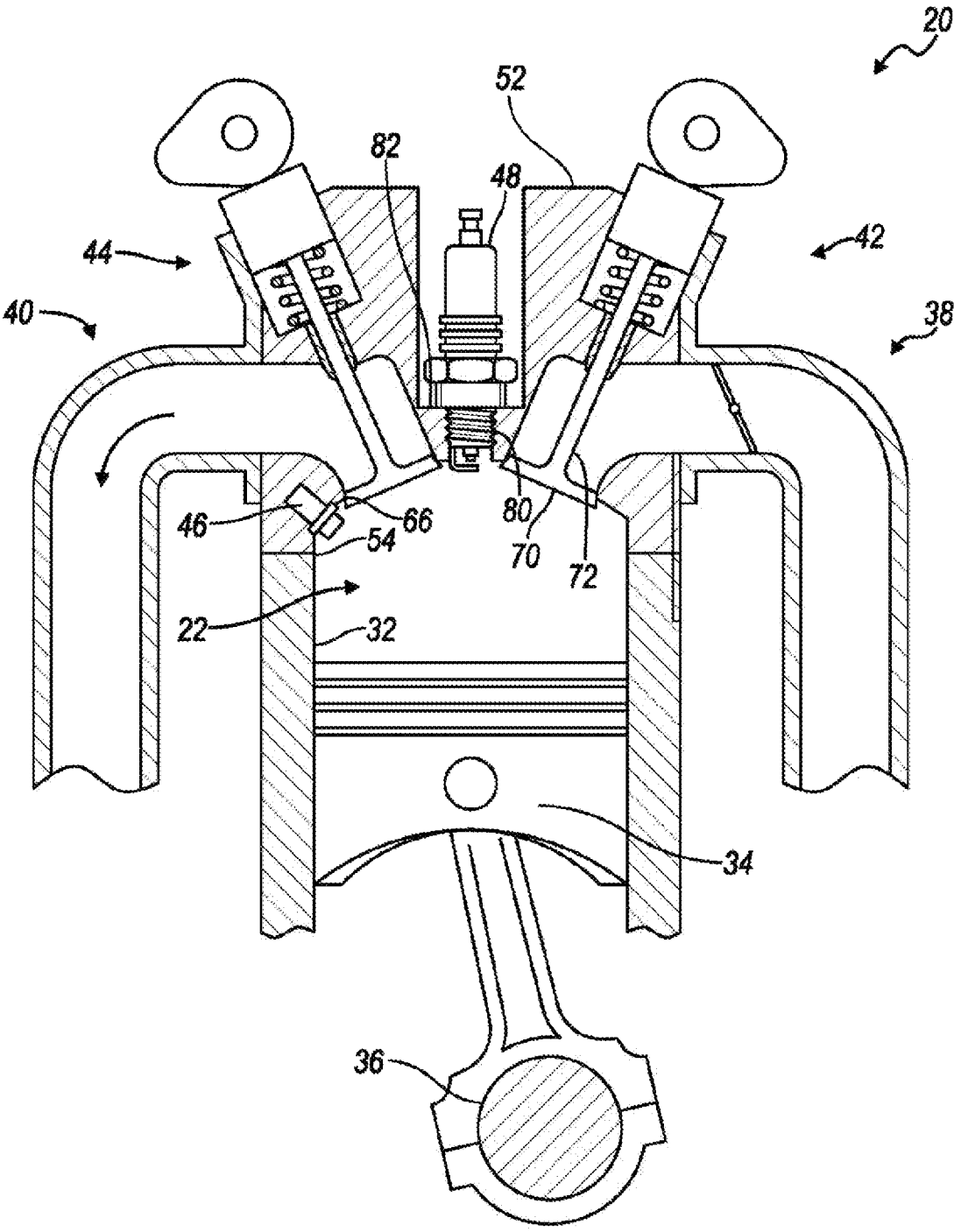
FIG. 1 is a schematic diagram of an engine shown in cross-section.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be, interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Directional terms used herein are made with reference to the views and orientations shown in the exemplary figures. A central axis is shown in the figures and described below. Terms such as "outer" and "inner" are relative to the central axis. For example, an "outer" surface means that the surfaces faces away from the central axis, or is outboard of another "inner" surface. Terms such as "radial," "diameter," "circumference," etc. also are relative to the central axis. The terms "front," "rear," "upper" and "lower" designate directions in the drawings to which reference is made and are not to be interpreted as limiting the disclosed concept to the illustrated embodiments or any specific spatial orientation. The terms, connected, attached, etc., refer to directly or indirectly connected, attached, etc., unless otherwise indicated explicitly or by context.

FIG. 1 illustrates a schematic of an internal-combustion engine 20. The engine 20 has a plurality of cylinders 22 (one cylinder is illustrated). The cylinder 22 (also referred to as a combustion chamber) is formed by cylinder walls 32 and a piston 34. The piston 34 is connected to a crankshaft 36. The combustion chamber 22 is in fluid communication with the intake manifold 38 and the exhaust manifold 40. One or more intake valves 42 control flow from the intake manifold 38 into the combustion chamber. One or more exhaust valves 44 control flow from the combustion chamber to the exhaust manifold 40. The intake and exhaust valves 42, 44 are operated to control engine operation. For example, each valve 42, 44 may be mechanically operated by a respective camshaft, or alternatively, may be hydraulically or electrically controlled.

In the illustrated embodiment, the engine 20 has direct injection meaning that the fuel injector 46 delivers fuel directly into the combustion chamber 22. In other embodiments, the engine 20 may include port fuel injection or a combination of both port injection and direct injection.

An ignition system includes a spark plug 48 that is controlled to, provide a spark that ignites the fuel-air mixture in the combustion chamber 22. The spark plug 48 may be located in various positions within the combustion chamber 22.

The engine 20 includes a controller and various sensors configured to provide signals to the controller for use in controlling the air and fuel delivery to the engine, the ignition timing, valve timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP) sensor, an engine position sensor for crankshaft position, an air mass sensor in the intake manifold 38, a throttle position sensor, and the like.

The cylinder head 52 defines an intake port 60. The intake port 60 provides a passage for flow of intake air or intake gases from the intake manifold 38 to a respective cylinder 22. Intake air may include outside or environmental air, may include fuel mixed therein, and may also be mixed with exhaust gases from an exhaust gas recirculation system, etc. The intake valve 42 seals the port 60 to prevent the flow of intake air into the chamber 22 when the intake valve 42 is in a closed position, and is opened to allow flow of intake air into the chamber 22.

The cylinder head 52 forms a spark plug port 80 that receives the spark plug 48. The spark plug port 80 may be threaded, for example, as a female threaded port. The port 80 extends through the cylinder head 52 such that the spark plug 48 can ignite a fuel-air mixture within the combustion chamber 22. An outer surface of the cylinder head forms a seat 82, and a seal may be formed between the spark plug 48 and the seat 82 to prevent gases from leaving the combustion chamber via the port 80.

Figure 2:
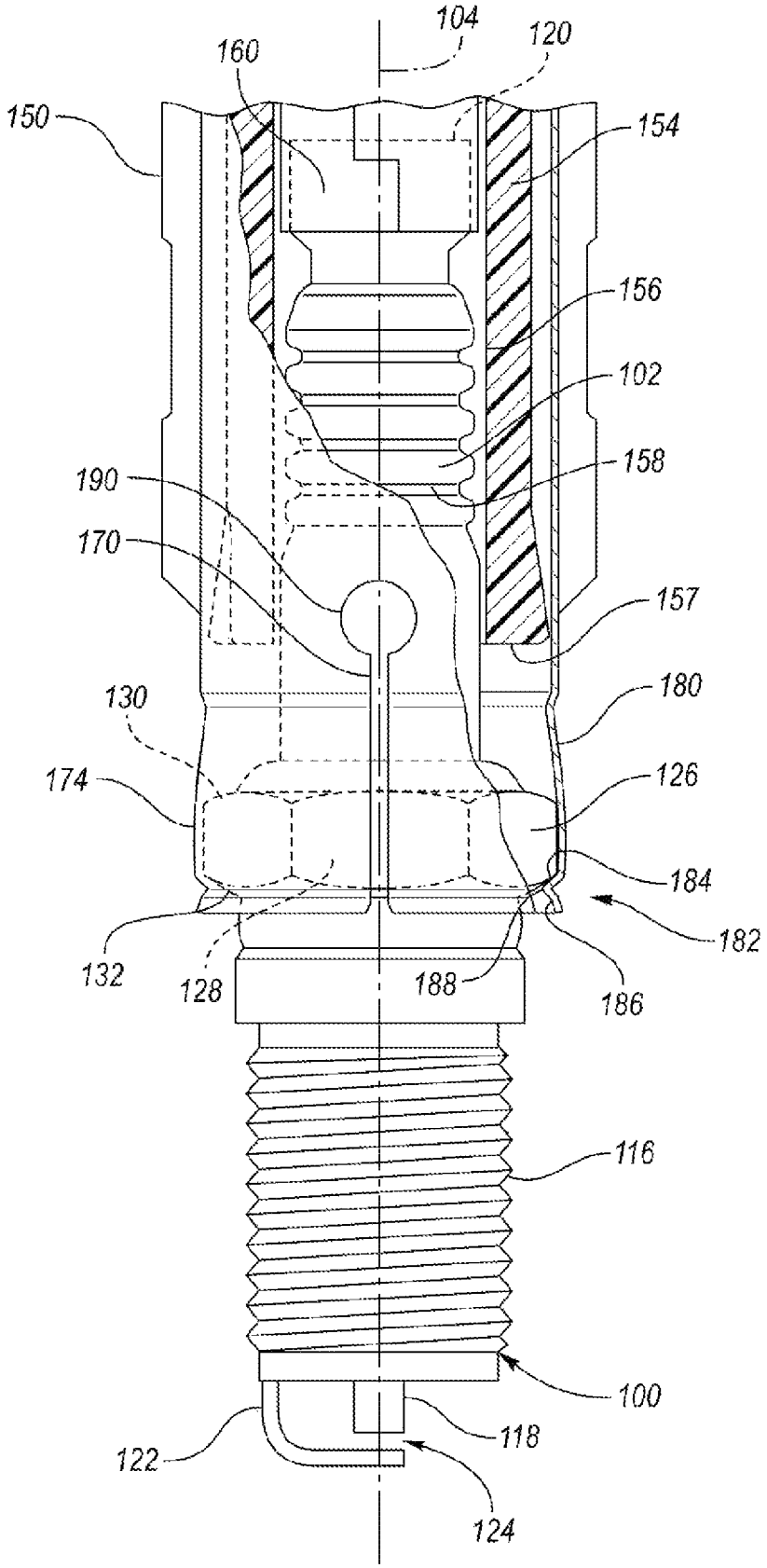
FIG. 2 is a side view of a spark-plug assembly shown in partial cutaway.

Referring to FIG. 2, a spark plug 100 is illustrated according to an embodiment. The spark plug 100 may be used as the spark plug 48 in the engine 20. The spark plug 100 has an insulator body 102. The insulator body 102 extends along a longitudinal axis 104 from a first end to a second end. The second end of the insulator body 102 may form a tip that extends into the combustion chamber and shields elements of the spark plug 100 from the high-temperature environment of the engine. The insulator body 102 is hollow and defines a passage that extends along the longitudinal axis 104 and through the insulator body 102 from the first end to the second end.

A central electrode 118 is positioned within the passage of the insulator body 102 and extends longitudinally. Although the central electrode 118 may be a single element, or may include a resistor and one or more springs, as well as an electrode. A terminal 120 is connected to the central electrode 118. The terminal 120 extends out from the first end of the insulator body 102 so that it can connect with a spark-plug wire.

The spark plug 100 also has a side ground electrode 122, or ground strap. The side ground electrode 122 is supported by the insulator body 102. The spark plug 100 may be provided with a single side ground electrode 122 as shown. In other examples, the spark plug 100 may have more than one side ground electrode 122. An electrode gap 124 is formed between the side ground electrode 122 and the end of the central electrode 118. In use, the side ground electrode 122 is electrically grounded by the cylinder head 52, while central electrode 118 is electrically isolated from the side ground electrode 122 via the insulator body 102. A gap 124 is formed between the end of the central electrode 118 and the side ground electrode 122. When the central electrode 118 is supplied with sufficient voltage and current, an electrical current crosses or jumps the gap 124 between the central electrode 118 and the side ground electrode 122, creating a spark that ignites the air-fuel mixture within the combustion chamber.

The spark plug 100 includes male threads 116 configured to threadably engage with the female threads formed in the cylinder head. A hex 126 is provided for screwing the spark plug 100 into the cylinder head. The hex 126 includes flat faces 128, e.g., six faces, formed on the circumference of the hex 126 and front and backsides 130, 132.

Figure 3:
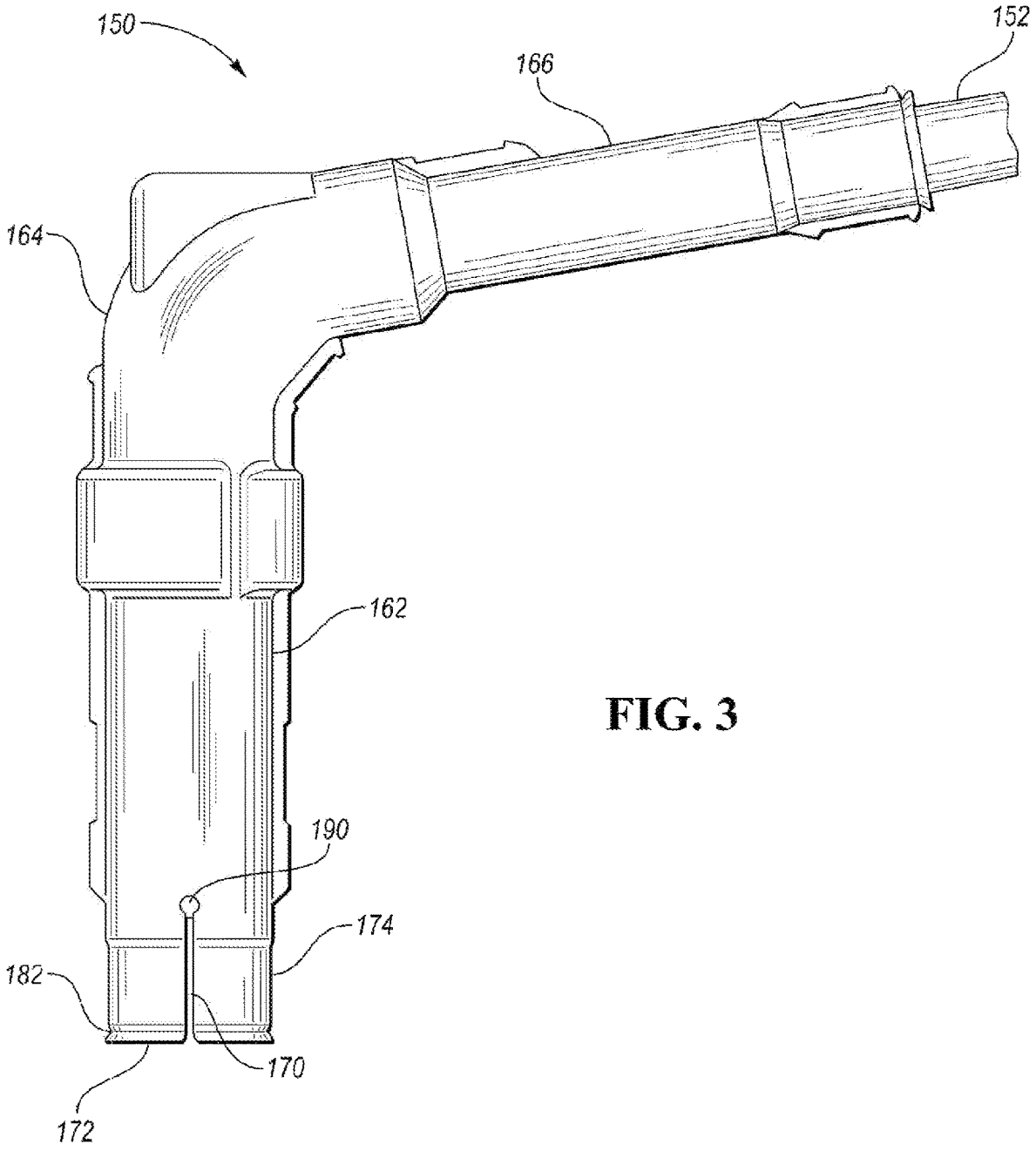
FIG. 3 is a-side view of a spark-plug wire.

Referring to FIGS. 2 and 3, a spark-plug, wire 150 connects the spark plug to the ignition system. The wire 150 includes, a boot 154 configured to be received on an upper portion of the spark plug and an electrical cable 152 that connects between the boot and the ignition system. The boot 154 is formed of the electrically insulative material, e.g., rubber. The boot 154 defines a central bore 156 configured to receive a post portion 158 of the spark plug. The spark-plug wire 150 is configured to provide electrical voltage and current to the spark plug.

Disposed within the central bore 156 is an electrical connector 160 that is configured to mechanically and electrically connect to the terminal 120 of the spark plug 100. The electrical connector 160 is electrically connected to the cable 152 so that electric current and voltage can be provided to the spark plug 100. The connector 160 is designed to mechanically couple to the terminal 120 such that a retaining force is provided. In traditional designs, the electrical connector 160 provides the retaining force to secure the wire to the spark plug. For example, the spark-plug wire electrical connector 160 has dimples facing inward. The dimples are resilient and can flex radially to expand over the spark plug terminal 120 during installation. The natural radially inward bias of the dimples rest in a reduced diameter channel in the terminal 120. This creates a retention force against the spark plug terminal 120. As will be explained in more detail below, the spark-plug wire 150 has further retentions features in addition to this retention at the connector 160.

Spark plugs frequently extend from the cylinder heads at a location that is hot. For example, the spark plugs may extend between runners of the exhaust manifold. The spark-plug wire 150 includes a heat shield 162 to protect the electrical components and the boot. The heat shield 162 is generally cylindrical and circumscribes the boot 154. In the illustrated embodiment, the heat shield 162 is L-shaped and includes a first portion 164 that is received around the boot 154 and a second portion 166 that is received around a lower portion of the electrical cable 152. The heat shield 162 may be formed of metal.

The retaining force provided by the terminal 120 is limited in some instances may be insufficient to robustly secure the spark-plug wires 150 to the spark plugs. Disclosed herein, is an improved heat shield 162 that is extended in length to project past the boot and includes retaining features that supplement the terminal 120. The retaining features are configured to grip the hex 126 of the spark plug to provide additional retention force.

In the illustrated embodiment, the heat shield 162 includes a plurality of slots 170 that extend longitudinally from a distal end 172 of the heat shield. The slots 170 define retaining features (e.g., gripping claws 174) configured to engage with the hex 126. The gripping claws 174 may be integrally formed with the heat shield 162. In the illustrated embodiment, the heat shield 162 includes four slots 170 to form, four gripping claws 174. Of course, this is just one example and the heat shield may include more or less gripping claws in other embodiments.

The gripping claws 174 extend past the distal, end 157 of the boot 154. In the illustrated embodiment, the gripping claws 174 begin roughly at the distal end 157 and extend towards the spark plug. The gripping claws 174 have a length sufficient to extend slightly past the hex 126 of the spark plug 100 when the wire 150 is installed. This allows the gripping claws 174 to snap-fit and grip to the backside 132 of the hex 126.

Each of the gripping claws 174 has a sidewall 180 defining a notch 182 extending radially inward. The notch 182 is arranged to extend circumferentially along the width of the gripping claws 174. In some embodiments, the notch 182 may circumferentially expand the entire width or may be partial. The notch 182 has an inwardly extending retaining surface 184 configured to engage with the backside 132 of the hex 126 and an outwardly extending guide surface 186 configured to facilitate installation of the gripping claws 174 over the hex 126. The notch 182 is generally V-shaped in the illustrated embodiment. As shown, the retaining surface 184 extends radially inward at an oblique angle from a main portion of the sidewall 180. The guide surface 186 extends, radially outward from an end of the retaining surface 184 (which is also the vertex of the notch) at an oblique angle. The angle of the retaining surface 184 may be steeper (more perpendicular relative to the centerline 104) than the guide surface 186. The vertex of the retaining surface 184 and the guide surface 186 form a ridge or innermost portion of the notch 182.

In aggregate, the ridges of the notches 182 define an intermittent circumferentially extending projection 188 of the heat shield 162. The projection 188 has a resting diameter that is smaller than the diameter of the hex 126. The gripping claws 174 are resilient and can flex radially to permit the heat shield 162 to be installed over the hex 126. During installation, the guide surfaces 186 act as ramps causing the gripping claws 174 to deflect, radially outward. Once the notches 182 clear the backside 132 of the hex 126, the natural radially inward bias of the gripping claws 174 snap-fit to the hex 126 with the projection 188 hooking over the backside 132 of the hex 126 and with the retaining surfaces 184 disposed mostly against the backside 132. Since the diameter of the projection 188 is less than the hex 126, interference is present to retain the spark-plug wire 150 to the spark plug 100 and create a retention force. The spark-plug wire 150 may be removed from the spark plug 100 by applying a pulling force that exceeds the retention force of the gripping claws 174, thus causing the gripping claws 174 to deflect radially outward to allow removal.

To increase the flexibility of the gripping claws 174, one or more of the slots 170 may include an associated circular hole 190. The circular hole 190 is located at an end of the slot 170 such that, the slot and the hole are continuous. The circular hole 190 may only be provided with some of the slots 170. For example, the heat shield 162 may include four slots 170 with only two of the slots including an associated circular hole 190. The two slots that have the associated hole may be diametrically opposite each other.

The heat shield 162 protects the spark-plug wire from engine heat and increases the retention force that retains the spark-plug wire 150 to the spark plug. The additional retention force of the heat-shield retaining features 174 in conjunction with the traditional electrical connector 160 disposed in the boot 154 reduce the likelihood of the spark-plug wire 150 from inadvertently disconnecting with the spark plug during both manufacturing of the vehicle and road use.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that, may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A spark-plug wire comprising:

a boot of electrically insulative material defining a central bore configured to receive a spark plug;

an electrical connector disposed in the central bore and configured to connect with the spark plug; and a cylindrical heat shield circumscribing the boot, the heat shield including retaining features extending pasta distal end of the boot and configured to radially flex to engage with a hex of the spark plug to increase a retaining force of the spark-plug wire to the spark plug.

2. The spark-plug wire of claim 1, wherein each of the retaining features includes a retaining surface extending radially inward.

3. The spark-plug wire of claim 1, wherein each of the retaining features includes a sidewall and a retaining surface extending radially inward from the sidewall and configured to engage with the hex.

4. The spark-plug wire of claim 3, wherein each of the retaining features further includes a guide surface extending radially outward from the retaining surface at an oblique angle to facilitate installation of the retaining features over the hex.

5. The spark-plug wire of claim 1, wherein the retaining features collectively define an intermittent circumferentially extending projection having a resting diameter that is smaller than the hex so that, when installed, the projection is configured to engage with the hex to increase the retention force.

6. The spark-plug wire of claim 1, wherein the retaining features are integrally formed with the heat shield.

7. The spark-plug wire of claim 6, wherein the heat shield is formed of metal.

8. The spark-plug wire of claim 6, wherein the heat shield includes longitudinally extending slots defining the retaining features.

9. A spark-plug wire comprising:

a boot;

an electrical terminal disposed in the boot and configured to couple with an electrode of a spark plug; and a cylindrical heat shield disposed around the boot and having a plurality of longitudinally extending slots defining gripping claws integral with the heat shield, the gripping claws being extendable over a hex of the spark plug to allow engagement with a backside of the hex, wherein the gripping claws are radially deflectable allowing the heat shield to be received past the hex and are biased radially inward to grip the backside and increase a retaining force of the spark-plug wire to the spark plug.

10. The spark-plug wire of claim 9, wherein the gripping claws collectively define an intermittent circumferentially extending projection having a resting diameter that is smaller than the hex so that, when installed, the projection forms a snap-fit with the backside of the hex.

11. The spark-plug wire of claim 9, wherein each of the gripping claws has a sidewall defining a notch extending radially inward, and wherein the notch has an inwardly extending retaining surface configured to engage with the backside of the hex and an outwardly extending guide surface configured to facilitate installation of the gripping claws over the hex.

12. The spark-plug wire of claim 11, wherein the notch is substantially V-shaped.

13. The spark-plug wire of claim 9, wherein the heat shield defines a circular hole disposed at an end of one of the slots.

14. The spark-plug wire of claim 13, wherein the hole and the one of the slots forms a continuous opening.

15. The spark-plug wire of claim 9, wherein the heat shield defines four slots and four gripping claws.

16. A spark-plug assembly comprising:

a spark plug; and a spark-plug wire including:

a boot;

an electrical connector disposed in the boot and coupled to a terminal of the spark plug; and a cylindrical heat shield disposed around the boot and having a plurality of longitudinally extending slots defining gripping claws integral with the heat shield, wherein the gripping claws extend over a hex of the spark plug to engage with a backside of the hex, and wherein the gripping claws are radially deflectable allowing the heat shield to be received past the hex and are biased radially inward to grip the backside and increase a retaining force of the spark-plug wire to the spark plug.

17. The spark-plug assembly of claim 16, wherein the gripping claws collectively define an intermittent circumferentially extending projection having a resting diameter that is smaller than the hex so that, when installed, the projection forms a snap-fit with the backside of the hex.

18. The spark-plug assembly of claim 16, wherein each of the gripping claws has a sidewall defining a notch extending radially inward, and wherein the notch has an inwardly extending retaining surface configured to engage with the backside of the hex and an outwardly extending guide surface configured to facilitate installation of the gripping claws over the hex.

19. The spark-plug assembly of claim 16, wherein the heat shield defines a circular hole disposed at an end of one of the slots.

20. The spark-plug assembly of claim 16, wherein the hex only engages with the gripping claws.

* * * * *